United States Patent [19]

Shenoha

[11] 4,373,436

[45] Feb. 15, 1983

[54] AXIALLY ALIGNED DRIVING CAM IMPRINTER

[75] Inventor: James L. Shenoha, Lockport, Ill.

[73] Assignee: Norwood Marking & Equipment Co., Inc., Downers Grove, Ill.

[21] Appl. No.: 158,632

[22] Filed: Jun. 11, 1980

[51] Int. Cl.[3] ..... B41F 31/16; B41F 1/00

[52] U.S. Cl. ..... 101/27; 101/336; 101/316

[58] Field of Search ..... 74/99 R, 99 A, 103, 74/107, 88; 101/27, 41, 44, 316, 292, 287, 21, 93, 69, DIG. 4

[56] References Cited

U.S. PATENT DOCUMENTS

| | | | |
|---|---|---|---|
| 2,953,344 | 9/1960 | Yancey | 74/110 |
| 3,421,637 | 1/1969 | Sofy | 74/110 |
| 3,543,681 | 12/1970 | Klenz | 101/44 |
| 3,823,664 | 7/1974 | Shenoha | 101/426 X |
| 3,878,776 | 4/1975 | Schneider . | |
| 3,881,410 | 5/1975 | Shenoha . | |
| 4,121,520 | 11/1978 | Shenoha | 101/316 |
| 4,160,410 | 7/1979 | Fichter . | |

OTHER PUBLICATIONS

K Series Brochure.

*Primary Examiner*—Richard J. Apley
*Assistant Examiner*—David J. Isabella
*Attorney, Agent, or Firm*—Hill, Van Santen, Steadman, Chiara & Simpson

[57] ABSTRACT

An intermittent motion imprinter particularly adapted for use with quick change cassette carried transfer tape to imprint spaced indicia by means of a reciprocating print head, the indicia being printed on a film strip, strip of labels, or product container passing the print head. Movement of the print head and advancement of the transfer tape is by means of a hydraulic or pneumatic cylinder driving a reciprocating shuttle. The print head has a centrally aligned axially extending shaft with a diametical slot therethrough. The shuttle passes through the slot and engages a cam roller affixed to the shaft within the slot, the cam contacting walls of a camming surface of the shuttle. The print head shaft is radially restrained in a bearing member and the shuttle is restrained against movement transverse to the reciprocal movement direction. The shuttle terminates in a projecting portion which engages a one-way drive for advancing the transfer tape.

4 Claims, 11 Drawing Figures

FIG. 3
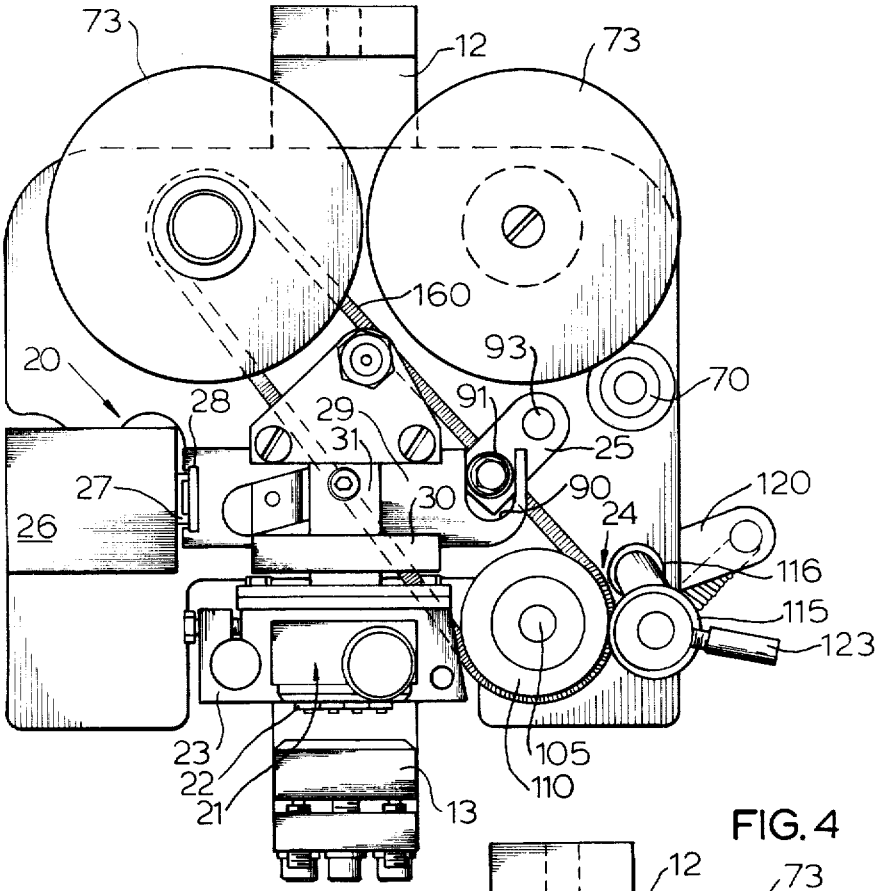
FIG. 4
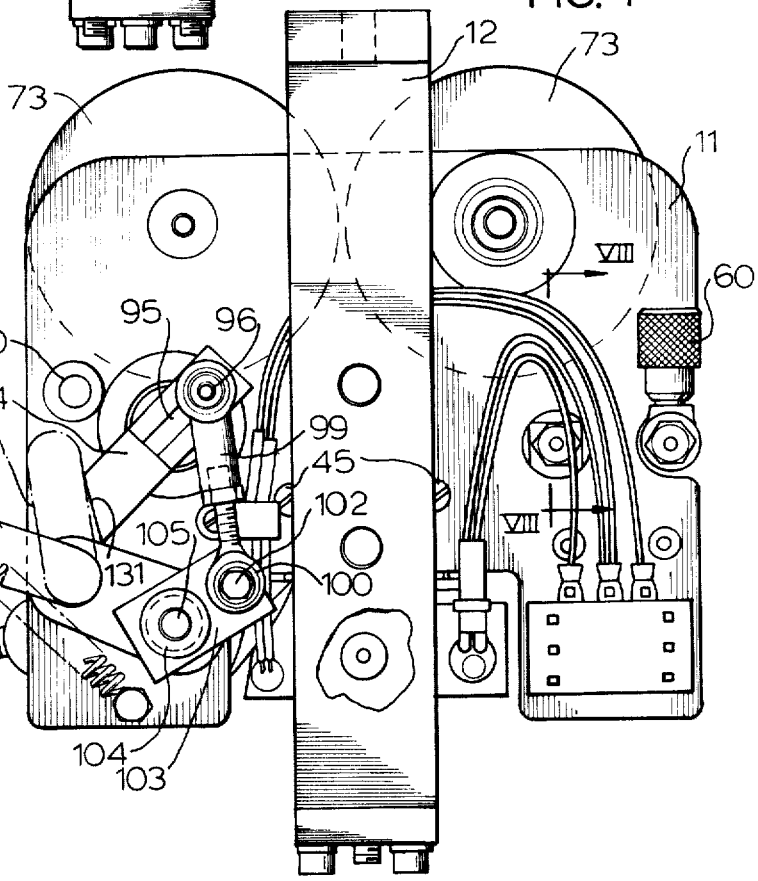
FIG. 9
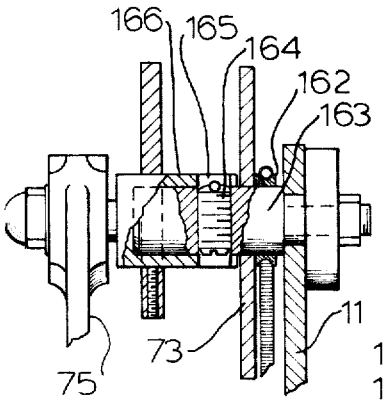
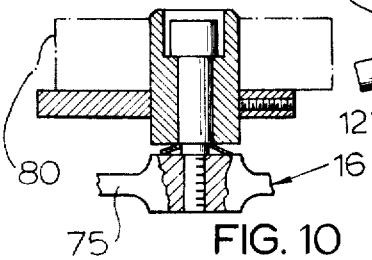
FIG. 10

AXIALLY ALIGNED DRIVING CAM IMPRINTER

BACKGROUND OF THE INVENTION

1. Field of the Invention

This invention relates to marking devices and more particularly, to intermittent motion transfer tape imprinters.

2. Prior Art

Imprint markers are commonly used in industry for various purposes including applying last minute information to product packaging, such as code dating, net weight, price and the like information which cannot advantageously be applied to the packaging at time of the original printing of the packaging.

Such marking devices generally fall into one of three categories: (1) ink devices such as those using stamp pads or ink rollers; (2) inked tape devices; and (3) transfer tape devices. This invention is particularly directed to transfer tape devices wherein the tape, sometimes referred to as a foil, is coated with a pigmentation which, under application of heat from a heated marker head, will cause transference of the pigment to the product to be marked.

Intermittent marking devices using transfer tape have two peculiar requirements not found in other marking devices. These are (1) necessity of complete withdrawal of the head from the tape and (2) complete advancement of the tape. The first requirement arises due to the fact that the head is normally heated so that the raised indicia which represent the marking to be applied to the product are kept at an elevated temperature. Since marking is intermittent, it is necessary for the head to be raised entirely out of contact with the tape except during the imprinting operation. This requires a relatively long stroke. Generally an anvil is positioned opposite the head, the product is passed over the anvil, the tape is positioned between the head and the product and either the head or the anvil is moved so as to bring the heated head into contact with the tape and the tape into secure contact with the product such that the tape and product are compressed between the head and the anvil.

For various reasons, it is sometimes preferable that the head move rather than the anvil. In this type of construction, the head must necessarily undergo a relatively large amount of movement towards and away from the anvil. Although this movement may be on the order of fractions of an inch, it remains a relatively large amount given the thickness of the transfer tape involved. Thus, in order to provide smear-free imprints, the head must be securely held against sway movements or any movements other than directly towards and away from the anvil.

The second requirement arises due to the nature of the transfer tape. Since the pigment of the tape in the area of the raised indicia of the head is entirely transferred to the product, any restrike of that area of the transfer tape will result in an incomplete imprint. Therefore, it is necessary to completely advance the tape between each strike by the imprint head. Ideally tape advancement is done on the retracting stroke of the marker head.

Recently, it has also become important to reduce the size of such imprinters to produce as compact a design as possible so that the imprinter may be installed on production machinery where relatively little space is provided. Finally, it has become important to allow for quick replacement of the transfer tape, either to change the color of the tape, or, more normally, to allow for quick replenishment of depleted tape rolls.

Numerous linkages and tape drive mechanisms have been suggested in the past. For example, in my U.S. Pat. No. 3,823,664, I employed a pneumatic cylinder which drove a shuttle which had spaced openings therealong. One of the openings engaged a camming member which caused tape advancement whereas the other opening drove one end of a bell crank arm supporting the moving anvil. This use of a common shuttle, both for movement of the anvil and the tape advance mechanism, allowed both functions to be carried out by a single power cylinder as compared to the required usage of two power cylinders to accomplish the separate functions shown, for example, in my U.S. Pat. No. 3,881,410.

A typical one-way clutch system for advancement of tape on the retract stroke of the power cylinder attached to a moving head is illustrated in U.S. Pat. No. 4,160,410 where, however, the head is otherwise freely attached to an end of the power cylinder arm and is merely supported by an underlying support. In my U.S. Pat. No. 4,121,520, I have shown a moving marker head which employs a projecting shaft on the marker head which is held in a sleeve bearing which greatly restricts movement of the marker head thereby insuring a quality imprint. In this latter patent, I provided a slot in the marker head shaft with a pin spanning the slot riding in the groove of an oscillating rocker drive member powered from a power cylinder. Although this construction provides a drive train having certain advantages, the necessity of using a rocking drive link requires that the power cylinder be hinged so as to allow the drive arm of the power cylinder to move both axially and laterally. This type of device, although effectively stabilizing the printing head, required the use of undesirable power transfer linkages, and results in a device having a relatively large axial dimension from the indicia to the point of connection to the power arm.

It would be an advance in the art to provide an imprint marker which provided the advantages of some of the prior art constructions while eliminating some of the disadvantages inherent therewith. Specifically, it would be an advance in the art to provide an intermittent imprint marker, of relatively compact size, wherein the print head is stabilized against sway; where the print head movement thrust is applied axially along the center line of the print head; where tape drive and print head movement are both provided by a single power source; and, where the drive linkage is securely guided having only reciprocal movement.

SUMMARY OF THE INVENTION

The above features are provided in the present invention by utilizing a reciprocating shuttle driven at right angles to the movement of the print head and passing through a projecting shaft of the tape head engaging a camming drive aligned axially with the tape head. The shuttle is guided for movement only in reciprocal back and forth directions and, restrained against all lateral movements, the shuttle includes both a cam slot for driving the print head and a connection to a drive for the tape advance means. The print head is provided with a projecting shaft which is securely received in bushings limiting nonaxial movement.

The imprint marker includes a base plate on which all of the drive mechanism is carried. Projecting from the base plate, and secured thereto, is a U-shaped cross-section bearing block having spaced top and bottom forwardly projecting legs. Vertical borings through the legs are aligned and serve as the bearing openings in which the shaft of the imprint head reciprocates. The top and bottom legs are grooved on their opposed faces and the shuttle rides in the grooves intermediate the legs. In this manner, the shuttle is held against movement other than reciprocating movement transverse the movement of the marking head shaft and the marking head shaft is held against movement other than reciprocating movement transverse the movement of the shuttle. An important feature of this invention is that the two moving force transmitting members, the shuttle and the head shaft, are both held in a single bearing block structure which provides both support and bearing surfaces. Because the shuttle is held against lateral movements, and because it is received in a slot through the head shaft, the head shaft will therefore be restrained against any rotational movements.

A power cylinder is carried on the base plate and has a power arm terminating in an enlarged head which is received in a "T" slot of the shuttle. In this manner, the power cylinder is easily removed independently of removal of the shuttle. The shuttle has a first inclined camming slot intermediate its ends which projects into the slot of the imprint head shaft. A cam wheel received in the slot of the shaft in centered in the inclined slot of the shuttle and is retained in position on the shaft by bolt means. In this manner, as the shuttle reciprocates, the cam wheel will ride along the walls of the inclined slot causing the imprint head to move transverse the shuttle movement. Adjacent its free end, remote from the power cylinder, the shuttle has a second cam groove in which a follower eccentrically affixed to a tape drive shaft rides. During reciprocation of the shuttle, the follower acts as a crank to the tape drive shaft which, through one-way clutching, drives an adjustable linkage to a pinch roller set through which the tape passes. By providing for an adjustable eccentric mount of the linkage to the tape drive shaft, the degree of rotation of the pinch roller for each reciprocation of the shuttle can be adjusted. A drive band between the pinch roller shaft and the tape take-up reel shaft assures that the tape will be drawn from the supply reel shaft through the pinch rollers, guided past the imprint head and taken up on the take-up reel.

Tape supply and take-up reels are carried on a removable cassette having a quick release snap lock connection to the main assembly. Drive connections are provided between the take-up shaft of the main assembly and the take-up reel of the cassette, with the supply reel of the cassette, if desired, being free rotating or, more preferably, rotatable but with a brake to prevent free wheeling.

It is therefore a principal object of this invention to provide an intermittent transfer tape imprint marker having a heated marking head with a projecting shaft, a drive shuttle powered by a drive means projecting through a slot opening in the shaft and reciprocatable at right angles to the direction of imprinting movement of the shaft, the shuttle and shaft having cooperating cam and follower means for transmitting a driving force from the shuttle to the shaft, and bearing means securing the shuttle and shaft for movement only in their respective transverse reciprocal directions.

It is another, and more specific object of this invention to provide a transfer tape imprinter having a heated head reciprocatingly movable towards and away from an anvil, the head having a projecting shaft received in a bearing means, a drive shuttle having a reciprocating movement transverse the movement of the head, the drive shuttle projecting through a slot opening diametrically of the shaft, cooperating cam and follower means between the shaft and the shuttle, the shuttle having drive link connection means to a tape advance drive and bearing means restraining the shuttle and shaft from movement laterally of the desired drive movement.

It is yet another, and more specific object of this invention to provide an improved transfer tape imprinter of compact size utilizing a reciprocating drive shuttle driving a reciprocating heated imprint head, the drive shuttle and head moving at right angles to one another and having a cam and follower interconnection therebetween, the shuttle having a drive connection to a tape transport system for moving a transfer tape past the imprint head, the head shaft and shuttle carried in a common bearing block restricting lateral movements from the desired reciprocal movements.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 3 is a view similar to FIG. 1 with the cassette removed.

FIG. 4 is a back elevational view of the imprinter of this invention.

FIG. 9, on page 2 of the drawings, is a fragmentary sectional view taken along the lines IX—IX of FIG. 7.

FIG. 10 is a fragmentary sectional view taken along the lines X—X of FIG. 7.

DESCRIPTION OF THE PREFERRED EMBODIMENT

Figure 1:
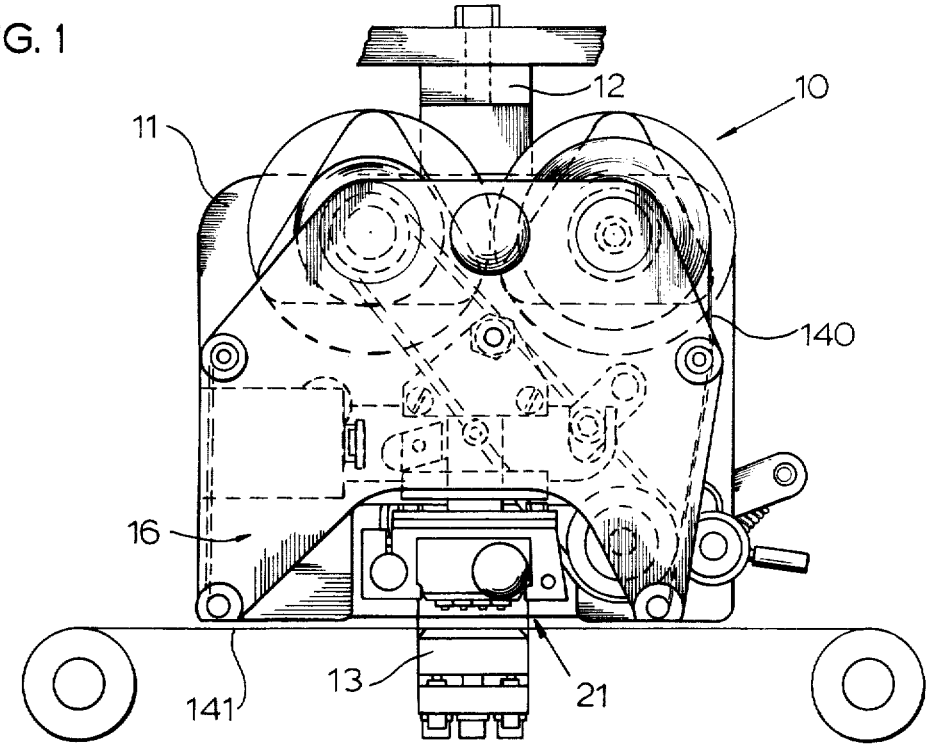
FIG. 1 is a front elevational view of an imprinter constructed according to this invention with underlying parts shown by broken lines.
Figure 2:
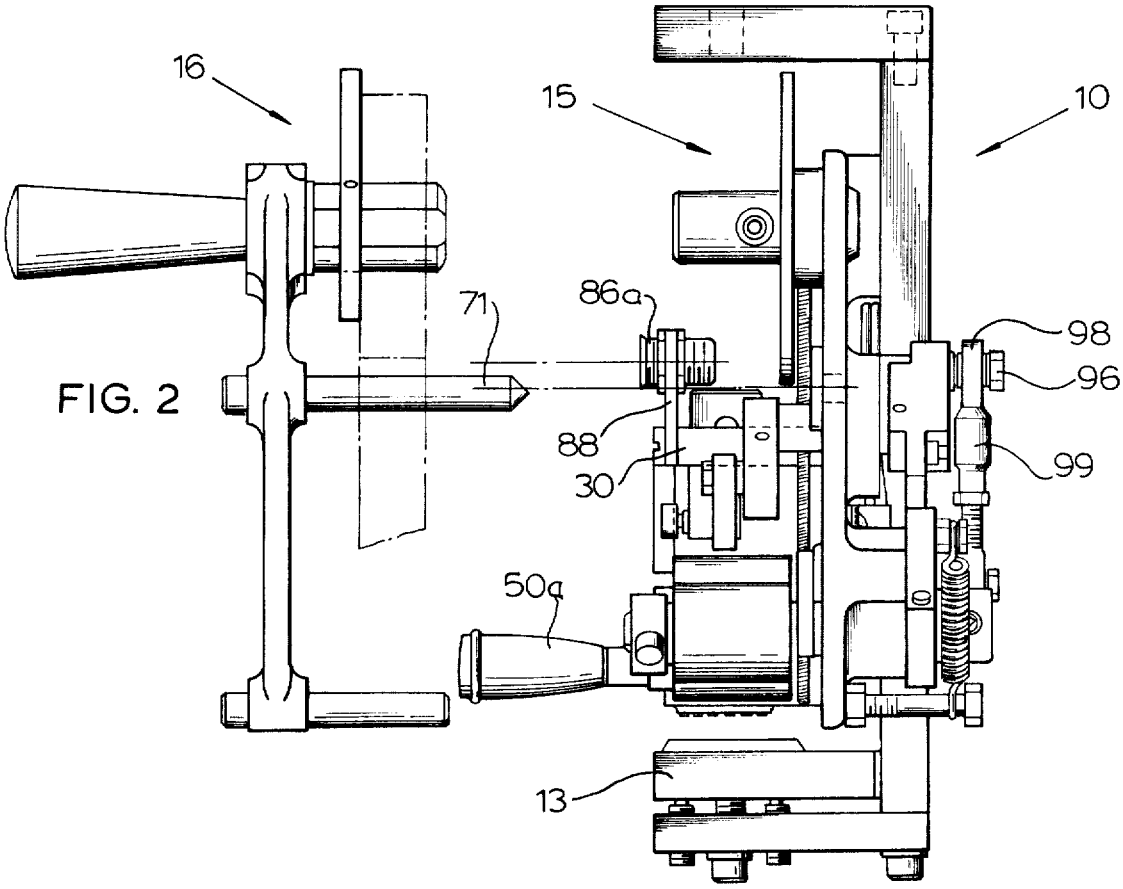
FIG. 2 is a side elevational view of the imprinter of this invention showing the cassette removed from the main portion of the imprinter.

FIG. 1 illustrates generally the imprinter 10 of this invention which includes a main frame 11 mounted on a mounting bracket 12, the mounting bracket extending the length of the imprinter on the back side thereof and terminating below the imprinter in an anvil 13. The imprinter, as best shown in FIG. 2, includes a main assembly 15 and a cassette 16 which is removable from the main assembly.

Figure 5:
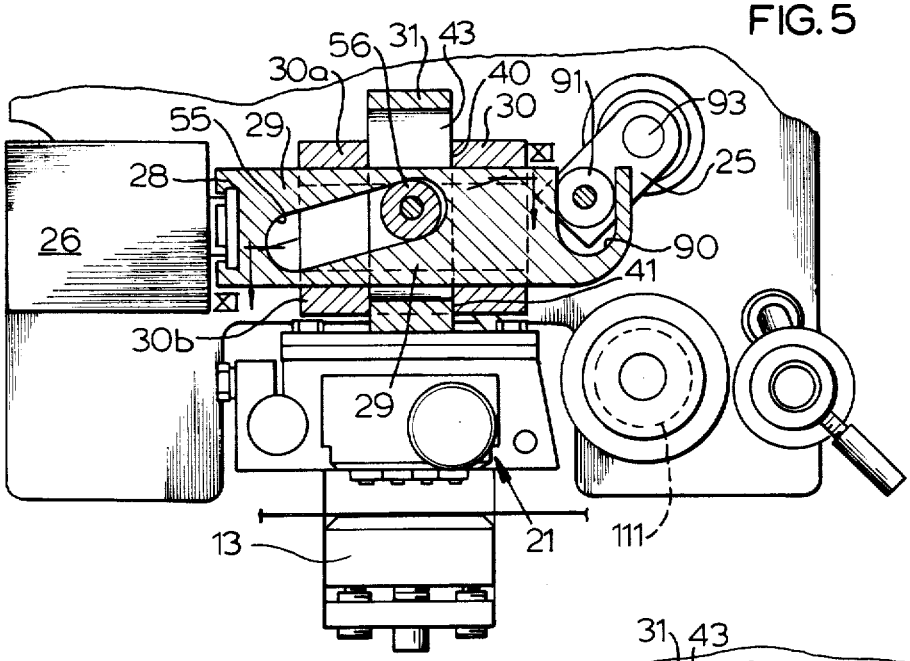
FIG. 5 is an enlarged fragmentary sectional view of the drive mechanism of the imprinter of this invention.
Figure 6:
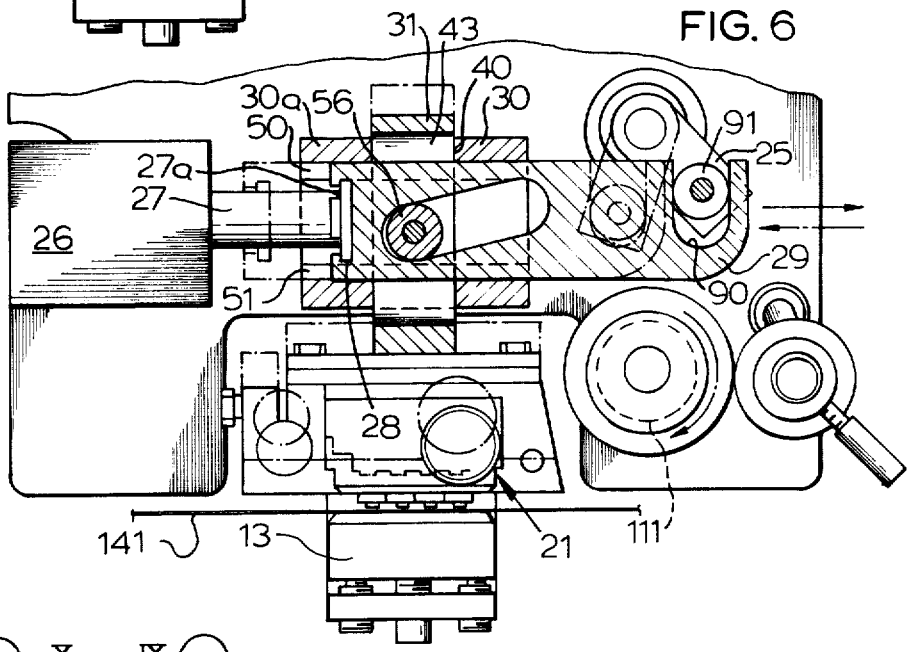
FIG. 6 is a view similar to FIG. 5 showing the drive mechanism in shifted imprint position.

As best shown in FIG. 3, the main assembly includes a drive mechanism 20, an imprint head 21 having raised indicia 22 thereon, a heater block 23 for heating the imprint head, a tape drive pinch roller set 24, and a tape drive crank 25. The drive mechanism 20 consists of a hydraulic or pneumatic cylinder 26 having an extendable power arm 27 received in a slot 28 of a shuttle 29. The shuttle 29 rides in a bearing block 30. The heat 21 has a shaft 31 projecting therefrom, the shaft extending through vertical circular bores 40 and 41 (FIG. 5) of the bearing block, the shaft having an intermediate slot 43 through which the shuttle 29 extends. As best shown in FIGS. 2, 5 and 6, the bearing block 30 is a U-shaped cross-section block having parallel extending top **30*a* and bottom 30*b* legs. Each of the legs has a groove 50 and 51 in its surface which opposes the other leg, the grooves being aligned and opposed to one another. The shuttle 29 is received in the grooves such that the shuttle is restrained against movement other than linear movement in the direction of the grooves. Thus, the grooves both support and restrain the shuttle from unwanted movement while providing a bearing surface for the movement of the shuttle. In order to heighten the bearing abilities of the bearing block 30, the block may preferably be formed of a gray iron or other material having bearing qualities. The shuttle bearing block is firmly affixed to the base plate 11 by means such as screws 45 extending through the base plate from the back thereof as shown in FIG. 4**.

The legs **30*a* and 30*b* have the above referred to circular bores 40 and 41 therethrough which are dimensioned with respect to the shaft 31 of the print head so as to receive and engage the circular cross-section shaft thereby providing spaced apart bearing surfaces for the shaft. In this manner, the shaft is supported and held against lateral movement. In the particular embodiment illustrated, the shaft may be formed as a part of the heater block 23 section of the head assembly with the print head portion 21 with the raised indicia being removable therefrom by means such as handle 50*a* (FIG. 2**). In other embodiments, if desired, the print head can be provided with the shaft and be a permanent part of the marker having other means for changing the indicia. When the term "print head" is used in this application, it is to be understood that either type of structure is referred to, i.e. the structure shown where a separate member is provided with a shaft and with grooving receiving an independent indicia carrying removable member, the print head including a heater block, or the type of device wherein the member which carries the indicia is integral with or otherwise attached to the shaft, or other head designs.

The shaft 31 has the slot portion 43 dimensioned along the shaft such that the slot has portions thereof between the legs **30*a* and 30*b* of the bearing block. The shuttle 29 extends through the shaft slot 43 and preferably has a shuttle thickness approximately equal to the slot opening width such that the side walls of the shuttle are closely spaced to, or engage the side walls of the slot 43. In this manner, the shaft 31** is prevented from rotating.

Figure 11:
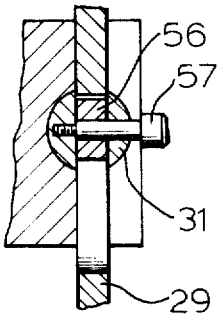
FIG. 11, on page 3 of the drawings, is a fragmentary sectional view taken along the lines XI—XI of FIG. 5.

As best shown in FIGS. 5 and 6, the shuttle 29 has a first camming slot 55 therethrough intermediate its ends. The first camming slot is an inclined slot. Positioned within the camming slot 55 is a cam follower 56. As shown in FIG. 11, the cam follower 56 is firmly affixed to the shaft 31 by means such as a bolt fastener or the like 57. Thus, as the shuttle reciprocates, the cam follower 56 will move upwardly or downwardly by engagement with the walls of the first camming slot 55. The follower 56 being affixed to the shaft 31 will therefore cause the marking head 21 to move towards and away from the anvil 13.

Figure 8:
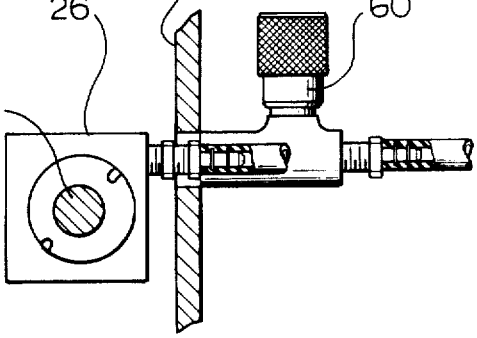
FIG. 8 is a fragmentary enlarged partially sectional view of the drive cylinder connection of the imprinter.

As shown in FIG. 6, the power member 26 has its power arm 27 terminating in a large dimensioned disc end **27*a* which is received in the slot 28 in the end of the shuttle. The slot 28 is T-shaped and is provided such that the cylinder 26, which may be a two way cylinder, can be easily removed for replacement without removing any other portion of the drive mechanism 20. To this end, the power member 26, as shown in FIG. 8, may be independently mounted on the back plate 11 and may include a regulator 60 (FIGS. 6 and 8**) for the air supply.

Figure 7:
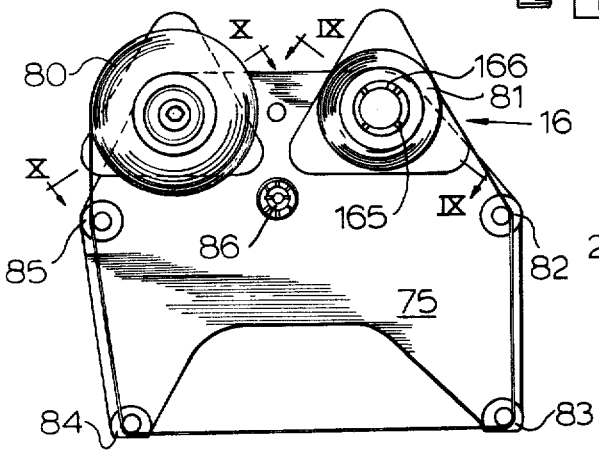
FIG. 7 is a back plan view of the cassette of the imprinter of this invention.

The back plate or main frame 11 has a bushed opening 70 (FIGS. 3 and 4) therethrough for alignment with an aligning pin 71 on the cassette 16. Additionally, the back plate or main frame is provided with two tape guard members 73 which may, for example, be circular plastic discs. The cassette 16 (FIG. 7) includes a frame member 75, tape supply 80 and take-up 81 reels, and guide posts 82, 83, 84 and 85. One of the guide posts, 85, is provided with an extended rounded or pointed end to form the alignment pin 71 which indexes with the bushed opening 70. The cassette 16 is also provided with a push to lockpush to release locking member 86 aligned to index with a socket portion of the lock **86*a* carried by plate 88 affixed to the front of bearing block 30. The guide pins 82, 83, and 84 are dimensioned to abut the back plate or main frame 11 when the pin 71 is projected through the bushed opening 70 and the lock 86-86*a*** is engaged.

In order to provide for tape movement, the shuttle 30 has a groove 90 therein adjacent its free end which projects beyond the bearing block 30 on the side of the bearing block 30 opposite the power cylinder 26. The groove 90, in the illustrated embodiment, is open to the top of the shuttle. A follower 91 affixed to crank arm 25 rides in the groove 90. Crank arm 25 is affixed to shaft 93 spaced from the shuttle 29 such that reciprocation of the shuttle will, due to the reaction of the follower 91 in the groove 90, cause rotation of crank 25 and shaft 93.

Shaft 93 extends through the base plate 11 and is affixed to a link member 94 best shown in FIG. 4. Link member 94 has a groove 95 therein which receives nut 96 in such a manner that the position of the nut 96 in the groove 95 is variable along the length of the groove. Because the groove extends beyond the center of the shaft 93, the degree of movement of the nut 96 for each partial rotation of the shaft 93, is effectively changeable by the amount of the distance eccentric to the center of shaft 93.

Nut 96 is received in a universal pivot carried by the end 98 of toggle 99. The other end 100 of toggle 99 carries nut 102 in another universal socket. Nut 102 connects with link 103 which in turn is connected through one-way clutch 104 to shaft 105. Shaft 105 extends through the base 11 to the front thereof where it forms the axle shaft for drive roller 110 (FIG. 3). An anti-back one-way clutch 111 (FIGS. 5 and 6) may also be provided on shaft 105.

Pinch roller 115 (FIG. 3) is carried on a shaft at the end of link 116. The other end of the link attaches to a shaft which passes through the base and has its other end affixed to arm 120. Arm 120 projects outwardly to the side of the base as shown in FIG. 4, and a spring 121 attached adjacent the end of arm 120 and having its other end affixed to the base, urges the arm in a direction clockwise as shown in FIG. 3. This urges the pinch roller 115 against the drive roller 110. A projection 123 attaches to the member 116 in such a way that the pinch roller 115 can be rotated counterclockwise from the position illustrated in FIG. 3 to allow for tape insert. The spring 121 is such that upon clockwise rotation of the arm 120 from the position shown in FIG. 4, the spring will be positioned over-center to hold the pinch roller outwardly away from the drive roller 110. In this manner, the cassette with the tape threaded around guide pins 82–85 can be easily attached to the main mechanism 15. As shown by the dotted line 130 of FIG. 4, when arm 120 is placed in the spring over-center position, it will lie adjacent the end 131 of member 94 affixed to shaft 93. Thus, upon rotation of shaft 93, the face 131 will contact the side of the arm 130 pushing it counterclockwise from the dotted line position in FIG. 4 to restore the pinch roller to engaged position with the drive roller 110. This provides an advantageous failsafe to insure that the tape advance drive functions each time the shuttle is cycled.

The tape advance functions in the following manner: as shuttle 29 is reciprocated to the right from the position shown in FIG. 5 to the position of FIG. 6, follower 91 will cause rotation of crank 25 which in turn will cause rotation of shaft 93. Rotation of shaft 93 will, in turn, cause clockwise movement from the position shown in FIG. 4 of the member 95 which through the turnbuckle 99 will cause link 103 to move clockwise from the position illustrated in FIG. 4. Due to the provision of the one-way clutch 104, however, this motion will not cause rotation of shaft 105. Since movement of the shuttle to the right from the position illustrated in FIG. 3 to the position illustrated in FIG. 6, will cause the print head 21 to be brought downward into contact with the transfer tape 140 and to press the transfer tape against the product 141 and the product against the anvil 13, all as shown in FIG. 6, the tape will print on the product without any movement of the tape taking place. Upon return of the shuttle to the left from the position illustrated in FIG. 6 to the position illustrated in FIG. 5, the movement of the follower 91, crank 25, shaft 93, member 95, turnbuckle 99, and link 103 will all be the reverse of the above description. Thus, link 103 will now move counterclockwise from the position illustrated in FIG. 4. In this movement, motion will be transmitted through the one-way clutch 104 to the shaft 105. This will cause clockwise rotation of the drive roller 110 thereby drawing tape 140 from the supply reel 80.

In order to draw the tape to the take-up reel, a spring drive belt 160 is received in a sheave affixed to shaft 105 of drive roller 110 and is also trained around a sheave 162 affixed to shaft 163. Shaft 163 has a detent 164 projecting radially thereof which is engaged in a groove 165 of shaft member 166. Shaft member 166 forms the core shaft of the take-up reel 81 of the cassette and is rotatedly carried by the cassette. Thus, rotation of the drive roller 110 will be transmitted through the belt 160 to cause rotation of the shaft of the take-up reel.

The amount of tape which is moved during each reciprocation of the shuttle is controlled by the degree of eccentricity of the nut 96 from the center of rotation of the shaft 93.

It should be appreciated that this particular construction has highly desired advantages. Because of the interaction of the print head shaft with the spaced bearings of the bearing block 30, the print head shaft groove 43 with the side walls of the shuttle 29, and the shuttle with the grooves 50–51 of the bearing block, a particularly stable drive mechanism is provided. The print head is restricted against rotational movement by engagement of the shaft 43 side walls with the side faces of the shuttle 29. The head is also restricted against any lateral or tilting movement because of the spaced nature of the bearings provided by openings 40 and 41. At the same time, shuttle 29 is restricted against any movements other than its desired reciprocal movement due to its being received in the grooves 50 and 51. In spite of this stability, however, disassembly and repair is greatly facilitated. As has been discussed, the power cylinder 26 is easily removed without disassembly of other portions of the drive mechanism due to the "T" connection with the shuttle. The shuttle is also easily removed from the bearing block by removing bolt 57 thereby disengaging the follower 56 from the print head shaft. Upon removal of the shuttle from one end or the other of the bearing block, the print head is easily dropped out of the bearing block. The bearing block in turn is held only by the screws 45. Thus, all wearable parts in the drive mechanism are easily disassembled for repair or replacement.

It can therefore be seen from the above that this invention provides an improved compact transfer tape imprinter having a reciprocating print head movable only in a plane transverse to the plane of movement of a reciprocating shuttle, the shuttle and print head received in a common bearing block with the shuttle passing through a slot in a shaft of the print head. A cam and follower interconnection between the shuttle and the print head translates lateral movement of the shuttle to axial movement of the print head shaft. The shuttle is also provided with a drive connection to a tape drive mechanism such that a single power member reciprocating the shuttle causes both movement of the print head and movement of the tape. By use of one-way clutches, tape movement is allowed to occur only during retraction of the print head from the print position.

Although the teachings of my invention have herein been discussed with reference to specific theories and embodiments, it is to be understood that these are by way of illustration only and that others may wish to utilize my invention in different designs or applications.

I claim as my invention:

1. In an intermittent imprint marker including base means, a reciprocatably movable marker head block, an opposed anvil, tape supply and take-up reels, a power member moved cam slot member having a first cam slot for driving a follower operably affixed to the head block, and a second cam for driving a tape advance drive roller, the improvement of a projecting shaft on the head block, a slot opening extending through the shaft spaced from the head block, the cam slot member projecting through the slot opening normal to the direction of reciprocal movement of the head block, the first cam slot aligned with the slot opening, a cam follower affixed to the shaft positioned in the first cam slot, the second cam being spaced from the first cam slot, and bearing means supporting the cam slot member, said bearing means including a bearing member having spaced parallel legs with opposed grooves therein and aligned openings therethrough, said shaft extending through the aligned openings and restrained against lateral movement thereby, the cam slot member received in the opposed grooves and retained against non-linear movement thereby, the slot opening and cam slot member cooperating to prevent rotation of the shaft.

2. In an imprinter of the type having an upstanding main frame, a reciprocal marker head block with an upstanding shaft, an anvil opposite said block, tape supply and take-up reels, guides directing a run of tape from said reels between said head block and anvil, and a tape advance drive, the improvements of a bearing block secured to said upright frame having an upright bore slidably supporting said head block shaft and a transverse slot intersecting said bore intermediate the ends thereof, a power driven shuttle slidably supported in said slot, said shuttle having an inclined slot intermediate the ends thereof, a cam follower mounted on said head block shaft riding in said inclined slot of said shuttle, a second cam follower driven by said shuttle and driving said tape advance drive, and said bearing block providing extended bearing surfaces for said shaft and shuttle to stabilize the marker head block against sway and to restrain the shuttle against lateral movements.

3. In the imprinter of claim 2, the additional improvement of a second slot in said shuttle receiving said second cam follower.

4. In the imprinter of claim 1, the further improvement of a U-shaped bearing block having top and bottom legs defining said transverse slot and said bore.

* * * * *